US007614453B2

(12) United States Patent
Spiering et al.

(10) Patent No.: US 7,614,453 B2
(45) Date of Patent: Nov. 10, 2009

(54) STRESS DISTRIBUTING WELLHEAD CONNECTOR

(75) Inventors: Michael W. Spiering, Kingwood, TX (US); Maoye Sun, Cypress, TX (US); Paul D. Bunch, Houston, TX (US); Eric D. Larson, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 370 days.

(21) Appl. No.: 11/445,065

(22) Filed: Jun. 1, 2006

(65) Prior Publication Data

US 2007/0277983 A1 Dec. 6, 2007

(51) Int. Cl.
*E21B 33/038* (2006.01)

(52) U.S. Cl. ..... 166/338; 166/339; 166/351; 166/368; 285/123.1

(58) Field of Classification Search ..... 166/338–340, 166/367, 368, 351, 360, 348
See application file for complete search history.

(56) References Cited

U.S. PATENT DOCUMENTS 4,496,172 A * 1/1985 Walker ..... 285/18
4,708,376 A * 11/1987 Jennings et al. ..... 285/315
5,174,376 A * 12/1992 Singeetham ..... 166/208
5,522,681 A * 6/1996 Pallini, Jr. ..... 405/223.1
6,070,669 A * 6/2000 Radi et al. ..... 166/368
6,293,343 B1 * 9/2001 Pallini et al. ..... 166/345
6,540,024 B2 * 4/2003 Pallini et al. ..... 166/348
6,609,731 B2 * 8/2003 DeBerry et al. ..... 285/123.4
7,040,407 B2 * 5/2006 Jennings et al. ..... 166/348
7,380,607 B2 * 6/2008 Thomas ..... 166/348

* cited by examiner

*Primary Examiner*—Thomas A Beach
*Assistant Examiner*—Matthew R Buck
(74) *Attorney, Agent, or Firm*—Fletcher Yoder

(57) ABSTRACT

In accordance with certain embodiments, the present invention provides a connector for attaching to a multi-toothed profile on a wellhead features a tooth profile that staggers loading preferably starting at a loading surface furthest from the connector body sitting on the wellhead and moving toward the connector body. The staggered loading more evenly distributes stresses on the matching loading surfaces as compared to the result of using a tooth profile on the connector that nearly exactly matches the profile on the wellhead. The joint can then take advantage of an increased preload and exhibit improved stress characteristics when operating at high loading conditions.

4 Claims, 6 Drawing Sheets

STRESS DISTRIBUTING WELLHEAD CONNECTOR

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND

In accordance with certain embodiments, the present invention relates to the field of connectors that attach to multi-toothed profiles on subsea wellheads and, more particularly, to connector profiles that better distribute stress among the teeth to strengthen the connection.

Connectors are employed to attach certain types of equipment to wellhead housings. One common example provides attaching blowout preventer equipment to a subsea wellhead. Bodies that house a blowout preventer are connected to a wellhead. Early designs of such a connection involved a generally C-shaped clamp that was forced to move radially to capture a pair of spaced flanges on the wellhead and the body of the blowout preventer. One example of this single contact surface for this type of collet connector is shown in U.S. Pat. No. 3,096,999. Another form of engagement uses a series of contact surfaces performing a similar connecting function as single surface, but the loading is now distributed on the multiple surfaces available. A common example of this connection kind is the Vetco H4 wellhead. Connector designs in the past may have varied in actuation techniques or size and shape of locking dogs, but one thing they all had in common was that the tooth profile was designed to match the wellhead profile for the size and spacing of engaging teeth. Some examples of such closely matched connector profiles to the wellhead profiles can be seen in DX series connectors offered by Drill Quip, H-4 connectors from ABB Vetco Gray and similar products from Cameron. These products featured a group of radially moving dogs where the tooth profile on the dog matches the wellhead tooth profile, and an angled ring drove the profiles together to connect a body to the wellhead.

This practice has gone on for years without recognition of a limitation of such mirror image tooth profile designs in wellhead connector art. The problem not heretofore realized and addressed by the present invention is that using a mirror image tooth profile on the locking dog results in an unequal distribution of stress and contact forces on the loading surfaces, with the loading surface closest to the connector body on the locking collet and wellhead bearing a disproportionately large percentage of the stress and contact force among the loading surfaces. This occurs because from a common reference line on the locking collet the loading surface closest to the reference line experienced the lowest percentage elongation and thus carried more of the stress than loading surfaces progressively further from a common and stationary reference line. The elongation of the dog and compression of the wellhead makes the loads progressively lower for each tooth profile further from a common reference line.

The present invention, exemplary embodiments of which are discussed below, provides various benefits and abates various concerns, such as the concerns addressed above.

SUMMARY OF THE INVENTION

In accordance with certain embodiments, the present invention puts forward a staggered contact design where contact is first established at the lowermost end of the collet or dog and on the wellhead at a location furthest from the preventer body. Then, as the collet or dog is powered to move radially inwardly, additional loading surfaces come into contact in a direction approaching the connector body.

As further exemplary embodiments, the present invention provides a connector for attaching to a multi-toothed profile on a wellhead, the connector featuring a tooth profile that initially staggers loading starting at a loading surface furthest from the preventer body sitting on the wellhead and moving toward the preventer body. The staggered loading more evenly distributes stresses at the preloaded condition on the matching loading surfaces as compared to the result of using a tooth profile on the connector that nearly exactly matches the profile on the wellhead. The joint can then handle higher operating pressures and external loads with reduced risk of connection failure. Of course, the foregoing are just examples of the present invention and are not intended to limit the appended claims to the embodiments described.

These and other features of the present invention will be more readily understood by those skilled in the art from a review of the drawings and the description of the exemplary embodiments provided below. Finally, the claims that later appear are indicative of the full scope of the present invention.

DETAILED DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
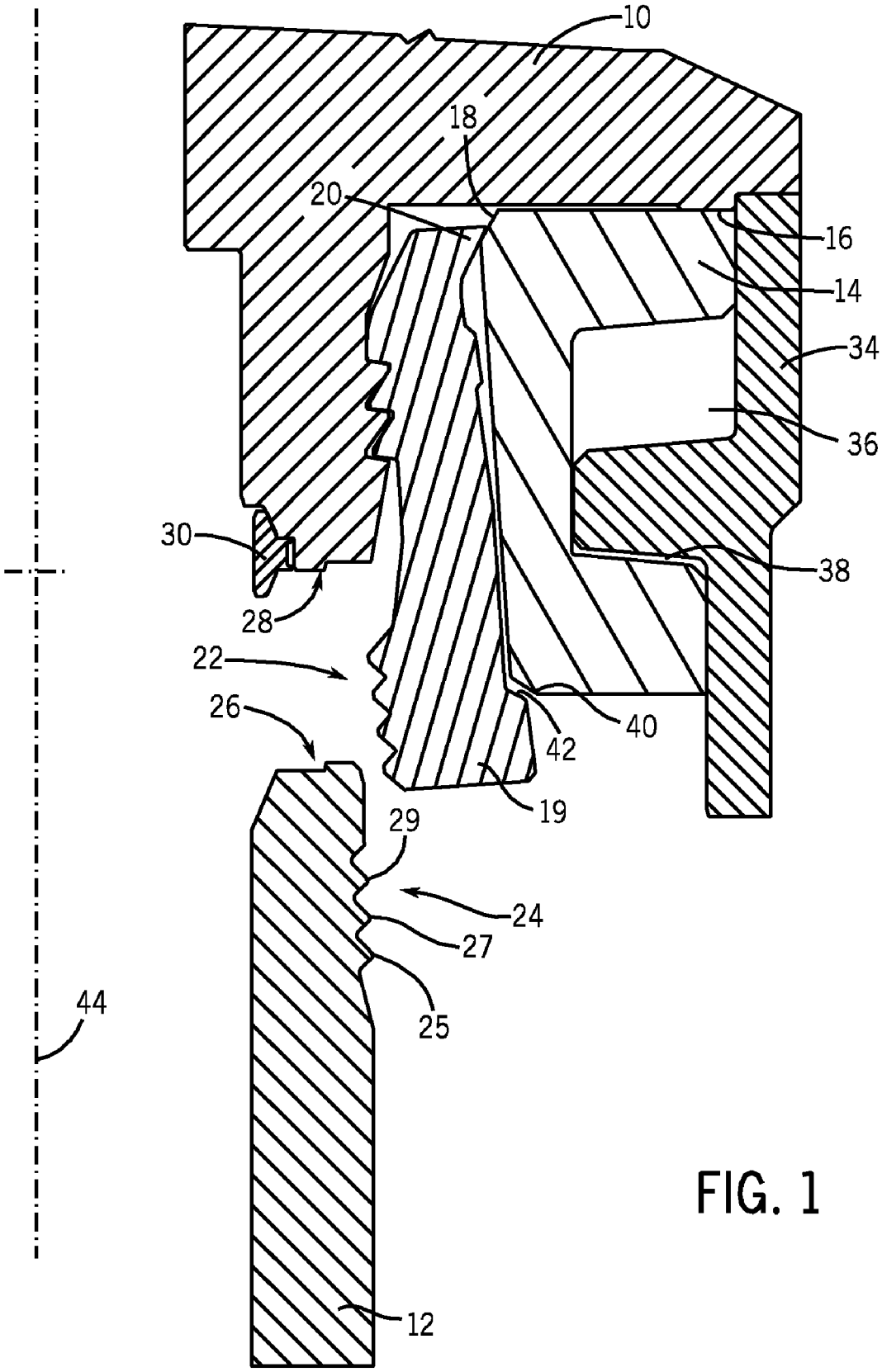
FIG. 1 is a section view of an exemplary connector in the fully open position.
Figure 2:
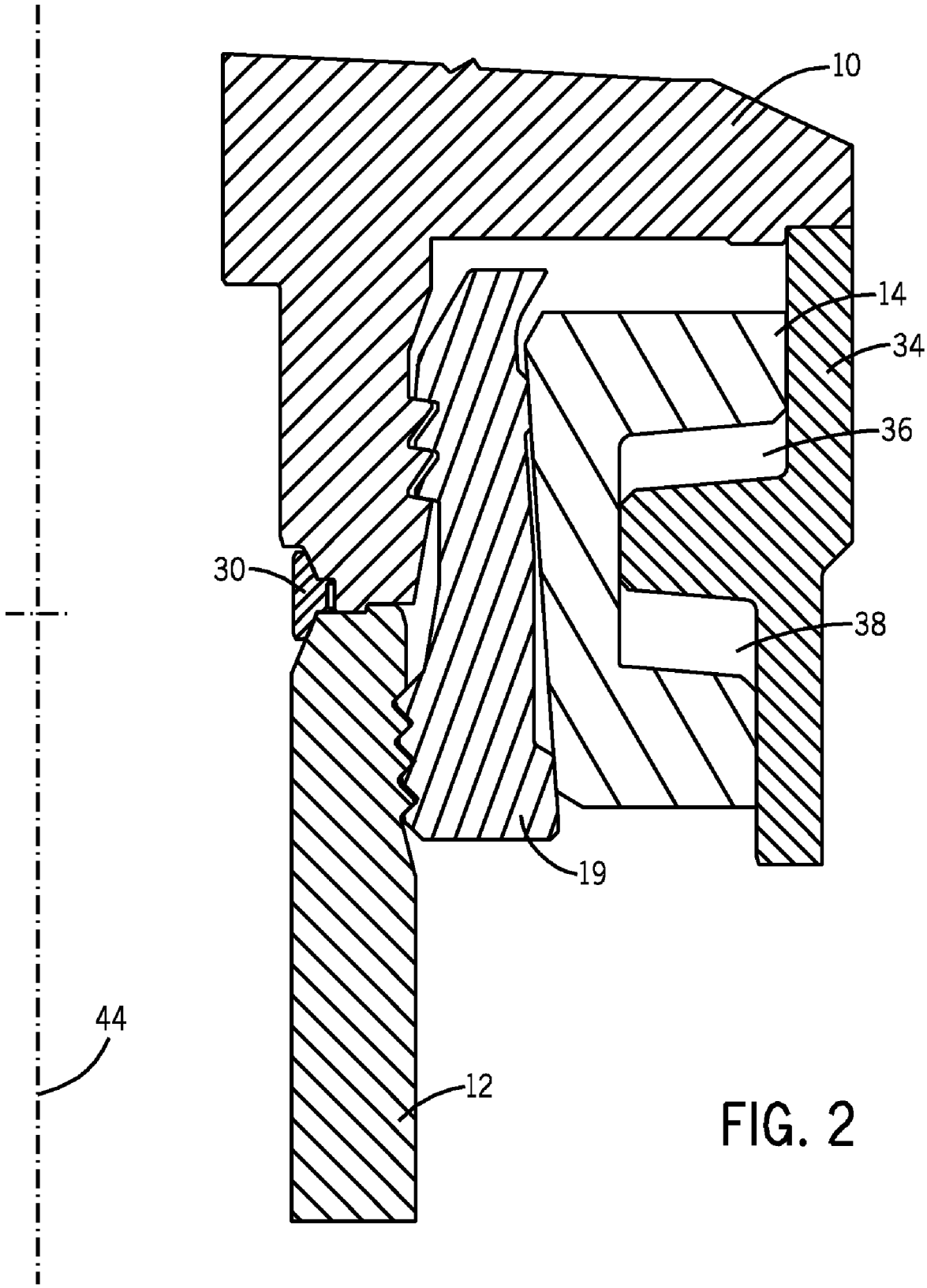
FIG. 2 is the view of the connector of FIG. 1 in the closed position.
Figure 3:
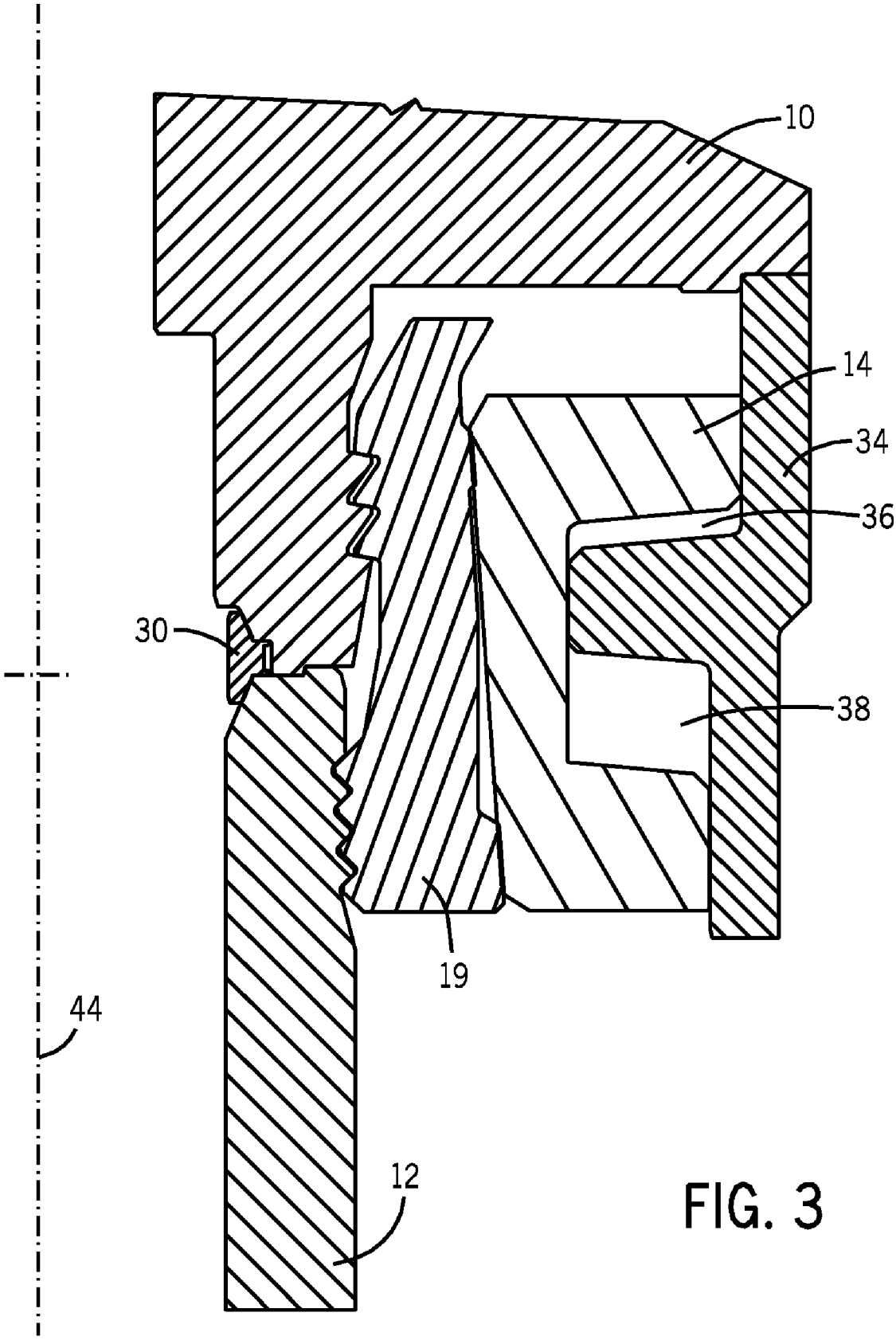
FIG. 3 is the view of the connector of FIG. 2 in the full preload position.

FIGS. 1-3 show the basic structure of an exemplary embodiment in 3 positions. When the body 10 is lowered onto the wellhead 12 the actuator piston 14 is abutting the surface 16 on body 10. The body 10 may facilitate connection of any number of components to the wellhead 12. Indeed, the body 10 may facilitate connection of a production tree, a blow-out-preventer, drilling-tools, among various kinds of tubular devices for oilfield use, to the wellhead. A taper 18 on piston 14 engages extending point 20 to retract the lower teeth 22 away from mating teeth 24 on the wellhead 12. This allows the body 10 to be lowered without the weight of it being supported on teeth 24. The top 26 of the wellhead 12 has a shape that, in this embodiment, conforms to the lower end 28 of body 10 so that when they go together, as shown in FIG. 2, the interface between surfaces 26 and 28 can be sealed by a seal 30. Piston 14 resides in housing 34 which defines two compartments 36 and 38 that are isolated from each other and sealed to accept hydraulic pressure for urging the collets 19 between the positions in FIGS. 1-3. Tapered surfaces 40 and 42 ride on each other as piston 14 moves down to force the collets 19 to move radially toward centerline 44.

The relation of the parts and the movements to secure the body 10 to the wellhead 12, in general, is by way of background to the invention, as the invention is addressed to the relation between the teeth 22 and 24. Those skilled in the art will know that most wellheads feature a tooth pattern 24 that has become an industry standard. The collet tooth pattern 22 thus forms a relationship to this industry standard pattern 24. The industry standard pattern 24 features a series of parallel ridges 25, 27 and 29. These generally are at a common fixed distance as between adjacent ridges. That said, embodiments of the present invention envision connecting to a variety of profiles in wellheads 12 that are commercially available or will be available in a manner that better distributes stress and contact forces as compared to currently available connector designs that emphasize a mirror image of the wellhead pattern on the collet that engages to it. Thus reference to teeth or engaging surfaces is not intended to be limited to particular existing wellhead patterns. Rather, such references relate to designs of interacting multiple surface assemblies that engage each other to attach a body such as a blowout preventer body to a wellhead.

Figure 4:
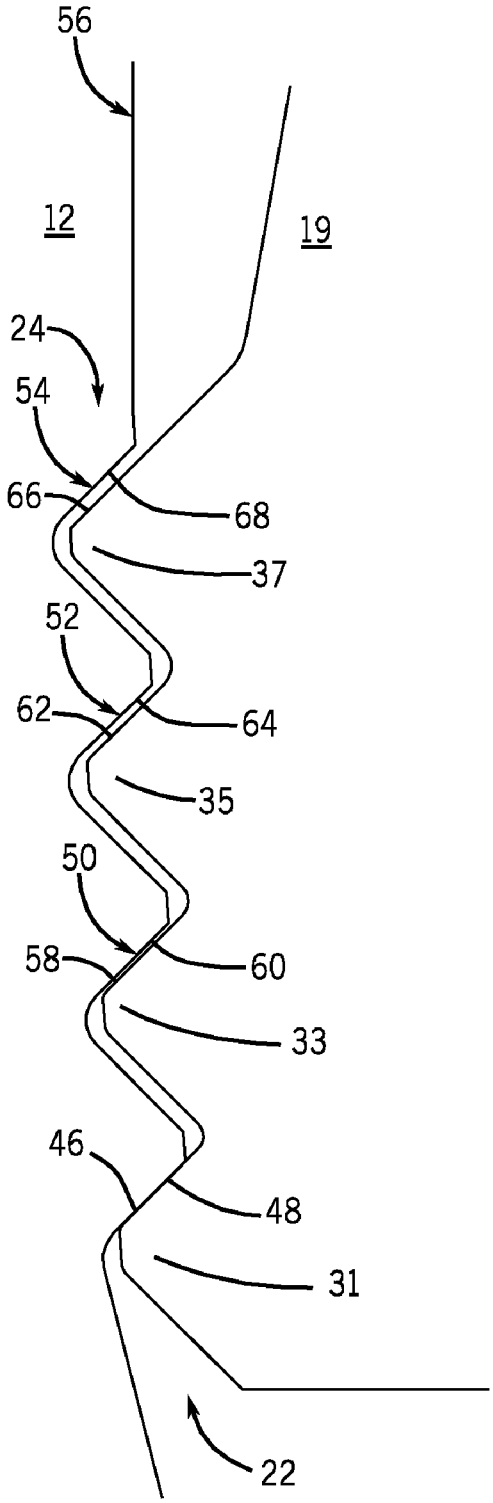
FIG. 4 is an exemplary close up view of the initial tooth contact.
Figure 5:
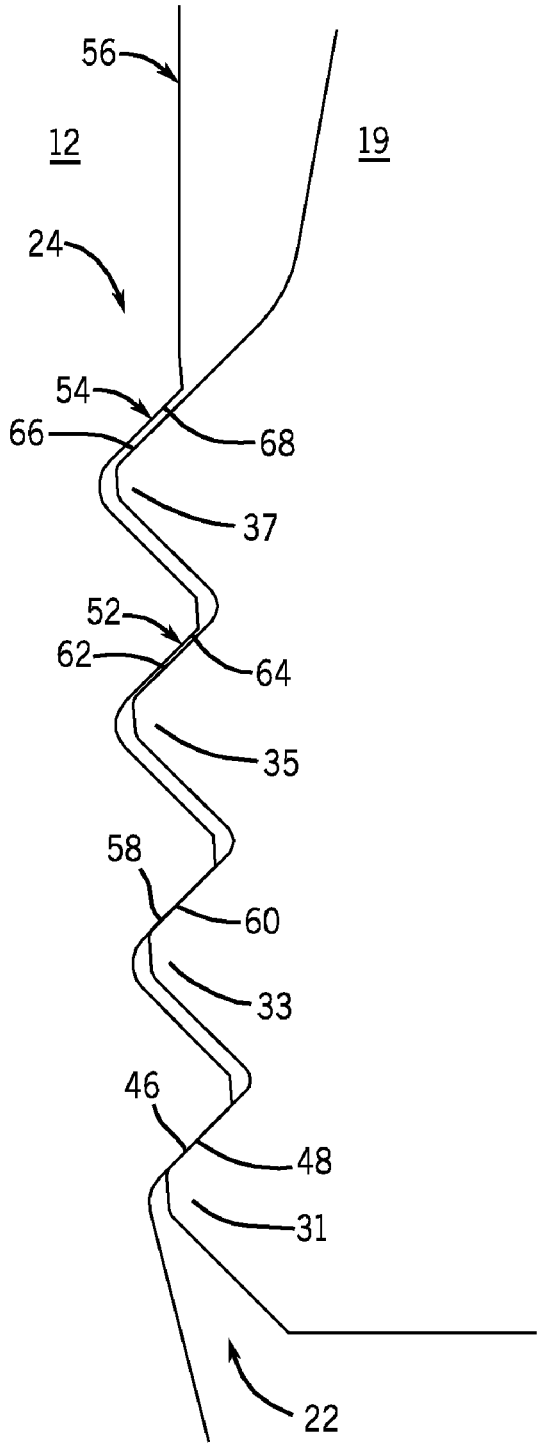
FIG. 5 is the view of FIG. 4 showing the start of radial movement of the collet.
Figure 6:
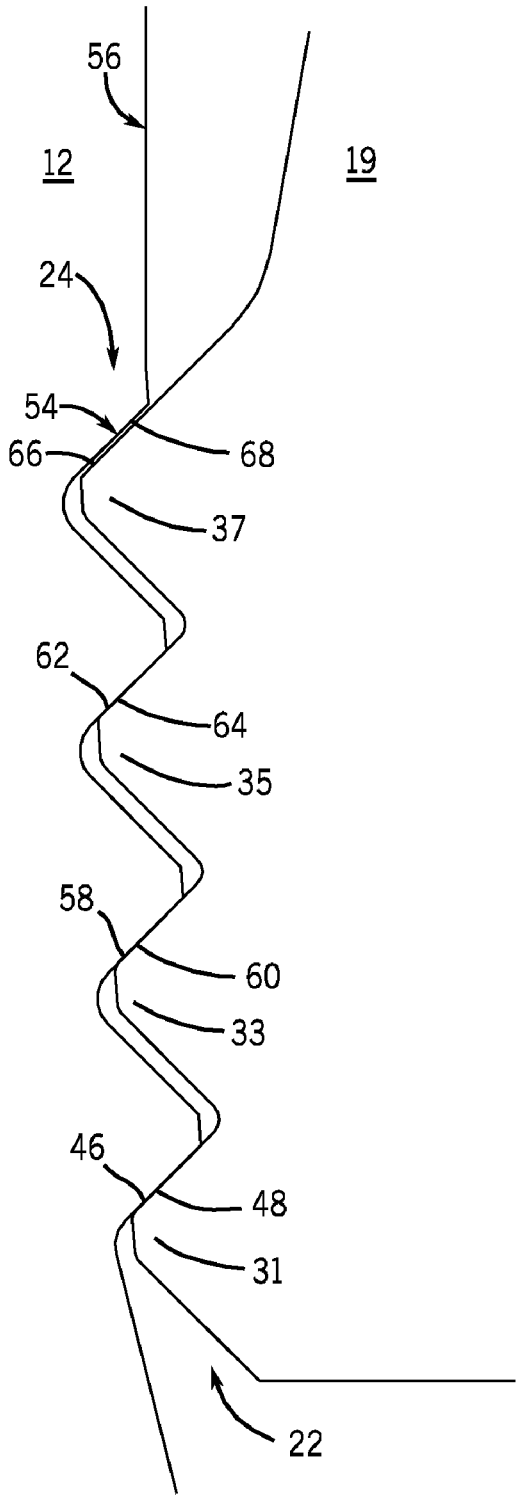
FIG. 6 is the view of FIG. 5 illustrating additional radial collet movement.
Figure 7:
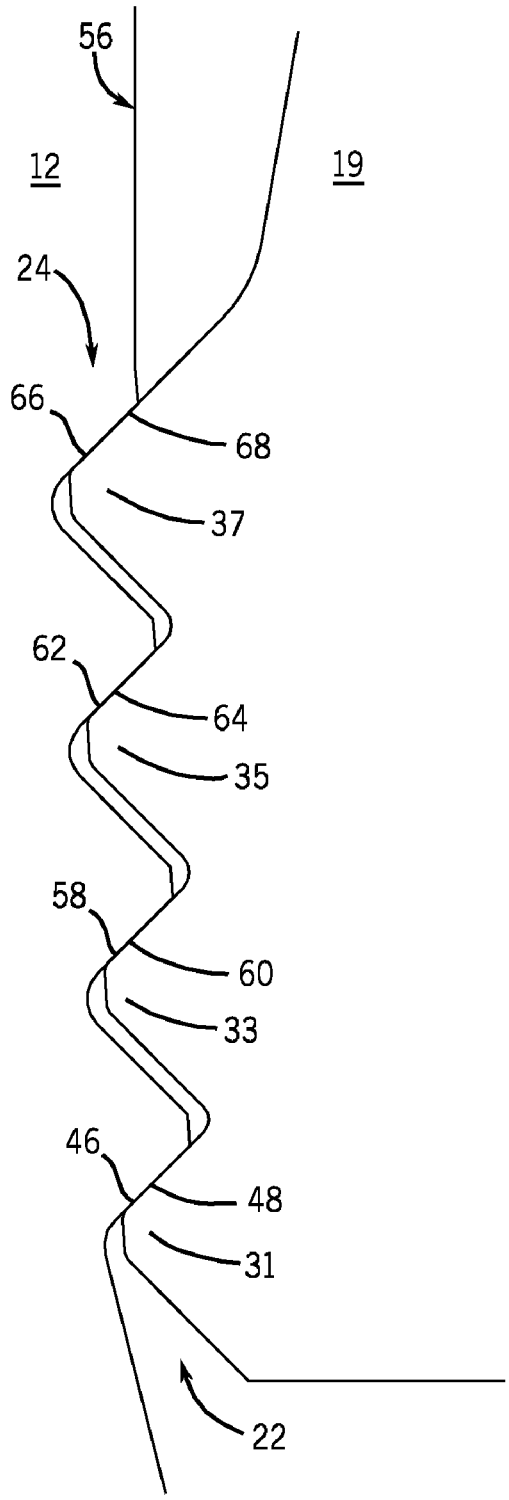
FIG. 7 is the view of FIG. 6 with radial collet movement completed.

Referring now to FIG. 4, the initial contact is by surface 46 on surface 48. At that point there are preferably gaps 50, 52 and 54 that are progressively larger as they are positioned closer to the upper end 56 of wellhead 12. As the collets move radially to start to apply preload, FIG. 5 illustrates that gap 50 has disappeared while gaps 52 and 54 still exist. Further radial movement of collets 19 shown in FIG. 6 shows only gap 54 remains. Finally in FIG. 7, all the gaps are gone as the radial movement of the collets 19 is finished. One reason this happens is that the spacing between adjacent teeth 31, 33, 35 and 37 on the collets 19 is not uniform. In the exemplary embodiment this spacing decreases as between adjacent teeth in a direction going toward upper end 56.

There are variations to the pattern in the FIGS. 4-6. For example, initial contact can leave only gaps 52 and 54 which then close up in series in a direction toward upper end 56. Alternatively, only gap 54 can be present at initial contact. To get stress distribution that is more equalized between or among loading surfaces the contact is preferably sequenced in at least two steps with the first being an initial contact location and the next being contact at another load surface preferably spaced between the initial contact location and the upper end 56 of the wellhead 12.

In the loading shown in FIGS. 4-7, when surfaces 58 and 60 begin contact, surfaces 46 and 48 have already been in contact and have had relative sliding movement between them. When surfaces 62 and 64 begin to contact, surfaces 58 and 60 have increased the stress level from their initial contact and surfaces 46 and 48 now also have greater stress than when they initially contacted and when surfaces 58 and 60 made initial contact. This pattern continues as surfaces 66 and 68 make contact.

The end result of this sequential contact is the stress and load distribution on the mating tooth profiles 22 and 24 is more balanced from top to bottom instead of being more concentrated toward the upper end 56 of wellhead 12. The prior designs featuring symmetrical tooth patterns for the collets and the wellhead stressed the uppermost teeth in the profile significantly more than the teeth closer to the collet lower end, where, for example surfaces 46 and 48 are located. By staggering the contact in a pattern using a plurality of pairs of contact surfaces from the downhole to the uphole direction, the resulting stress distribution is more uniform, improving the preload and increasing the integrity of the connection at higher loading conditions.

Figure 8:
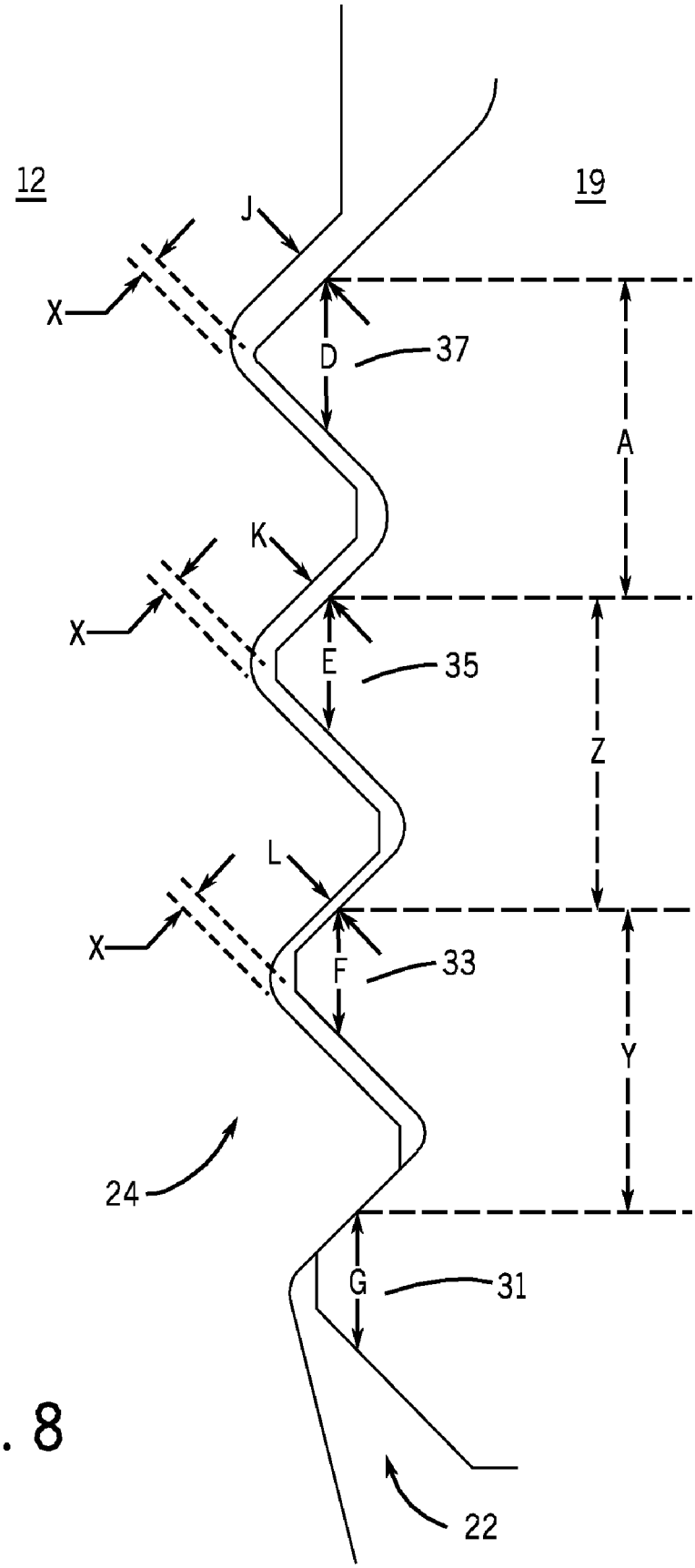
FIG. 8 is a detail view of an exemplary connector assembly.

Turning to FIG. 8, this figure illustrates in detail view an exemplary collet 19 in relation to, for example, a wellhead 12 it secures to. As illustrated, the mating teeth 24 on the wellhead 12 engage with the teeth 22 on the connector 19. The teeth 22 on the connector comprise a lower tooth 31, a lower intermediate tooth 33, an upper intermediate tooth 35, and an upper tooth 37. The number of teeth may be increased or decreased as desired. Moreover, although the lower tooth 31 is illustrated as initiating contact with the wellhead, the tooth of initial contact may be one of the other teeth, depending on the particular mechanics of the system, for instance. For example, the lower intermediate tooth 33 may be the tooth of initial contact.

With respect to these exemplary teeth, and incorporating any slope relationship that may be present with respect to these teeth, certain profile characteristics are present. For example, the distance from a given point on a ridge of a tooth to a corresponding point on a ridge of the same slope-polarity on the adjacent tooth decreases when progressing from a lower tooth to an upper tooth. For instance, in the illustrated embodiment, the distance represented by "Y" is greater than the distance represented by "Z", and the distance represented by "Z" is greater than the distance represented by "A." As another characteristic, the intermediate lower tooth 92 is thicker (distance "F": the distance from a point on a ridge to the corresponding point on the opposite ridge on the same tooth) than upper intermediate tooth 94 (distance "E"). Moreover, upper intermediate tooth 94 is thicker than upper tooth 96 (distance "D").

As a result of the arrangement presented in this figure, the gap represented by "J" is larger than that represented by "K", and the gap represented by "K" is larger than "L". Conversely, the distances represented by "X" are constant. Advantageously, an arrangement as such, as but one example, provides for the staggered engagement discussed above.

The above description is illustrative of the exemplary embodiments, and many modifications may be made by those skilled in the art without departing from the invention whose scope is to be determined from the literal and equivalent scope of the claims below. Again, the above description is illustrative of exemplary embodiments, and many modifications may be made by those skilled in the art without departing from the invention whose scope is to be determined from the literal and equivalent scope of the claims below.

The invention claimed is:

1. A method of joining a body to a wellhead comprising:

supporting the body on the wellhead having a first connection profile; and engaging the body to the wellhead by advancing a collet having a second connection profile that sequentially engages the first connection profile on the wellhead, wherein the second connection profile comprising first, second, and third teeth, wherein the axial distance from a first point on a first ridge surface of the first tooth to a corresponding second point on a second ridge surface of the second tooth is greater than the axial distance from the second point to a corresponding third point on a third ridge surface of the third tooth, wherein the axial distances of the second connection profile are sequentially different from corresponding axial distances between teeth of the first connection profile, and wherein the second connection profile engages the first connection profile on the wellhead in a sequential manner due to the sequentially different axial distances, such that the first tooth engages the first connection profile before the second tooth engages the first connection profile, and the second tooth engages the first connection profile before the third tooth engages the first connection profile.

2. The method of claim 1, comprising making the direction of sequential engagement go from the wellhead toward the body.

3. A connector assembly, comprising:

a collet connector secured to a tubular member and configured to couple the tubular member to a wellhead having a first connection profile disposed on an exterior thereof, the collet connector comprising:

a moveable member configured to actuate in a radially inward direction of the collet; and a second connection profile configured for interlocking engagement with the first connection profile, the second connection profile comprising first, second, and third teeth;

wherein the axial distance from a first point on a first ridge surface of the first tooth to a corresponding second point on a second ridge surface of the second tooth is greater than the axial distance from the second point to a corresponding third point on a third ridge surface of the third tooth, wherein the axial distances of the second connection profile are sequentially different from corresponding axial distances between teeth of the first connection profile; and wherein the second connection profile is configured to engage the first connection profile on the wellhead in a sequential manner due to the sequentially different axial distances, such that the first tooth engages the first connection profile before the second tooth engages the first connection profile, and the second tooth engages the first connection profile before the third tooth engages the first connection profile.

4. The assembly of claim 3, comprising an actuation device configured to actuate the moveable member in the radially inward direction.

* * * * *

UNITED STATES PATENT AND TRADEMARK OFFICE

CERTIFICATE OF CORRECTION

PATENT NO. : 7,614,453 B2
APPLICATION NO. : 11/445065
DATED : November 10, 2009
INVENTOR(S) : Spiering et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 532 days.

Signed and Sealed this

Fourteenth Day of December, 2010

David J. Kappos

David J. Kappos
*Director of the United States Patent and Trademark Office*